United States Patent [19]

Mazzaferro

[11] 4,012,811

[45] Mar. 22, 1977

[54] MOLDED PLASTIC CLAMP

[76] Inventor: Joseph Mazzaferro, 325 Hamilton St., Leominster, Mass. 01453

[22] Filed: Jan. 21, 1976

[21] Appl. No.: 651,058

[52] U.S. Cl. ..... 24/84 H; 24/255 SL; 223/91

[51] Int. Cl.[2] ..... A44B 21/00

[58] Field of Search ..... 24/84 H, 255 SL; 223/91

[56] References Cited

UNITED STATES PATENTS

| | | | |
|---|---|---|---|
| 3,392,727 | 7/1968 | Hanlon | 24/255 SL |
| 3,665,563 | 5/1972 | Batts | 24/258 |
| 3,698,043 | 10/1972 | Batts | 24/84 H |
| 3,737,943 | 6/1973 | Store | 24/255 SL |
| 3,745,616 | 7/1973 | Batts | 223/96 |
| 3,755,859 | 9/1973 | Solari | 24/84 B |
| 3,809,094 | 5/1974 | Cook | 128/346 |
| 3,823,443 | 7/1974 | Takabayashi | 24/255 SL |
| 3,923,213 | 12/1975 | George | 24/84 H |
| D234,204 | 1/1975 | Miller | 24/255 SL |

*Primary Examiner*—Paul R. Gilliam
*Attorney, Agent, or Firm*—Charles R. Fay

[57] ABSTRACT

A one piece molded plastic clamp originally molded flat and having two main clamping elements adapted to fold together to clamp an article therebetween, each element being provided with a single aperture, one aperture providing a hook for hanging the clamp with an article clamped therein, and the other aperture including an edge for snap fastening cooperation with an angularly extending undercut tongue on the opposite clamping element. The free ends of the clamping elements are reinforced and toothed for better clamping of an article therebetween.

3 Claims, 4 Drawing Figures

MOLDED PLASTIC CLAMP

BACKGROUND OF THE INVENTION

There have been many suggestions for making inexpensive, molded, easily operated clamps for hanging garments e.g., on racks, wires, lines, etc., and among these are U.S. Pat. Nos. 3,665,563 and 3,698,043. It is the object of the present invention to provide an improved one piece molded garment clamp which is simpler and less expensive than the prior art.

SUMMARY OF THE INVENTION

In the present case a clamp is molded in two contiguous and integral elements in a flatwise condition, said clamp elements having parallel side flanges on corresponding faces thereof and toothed reinforced article engaging means at the free ends thereof on the opposite sides, the clamp being molded flatly in one piece and each of the two clamping elements being provided with an aperture, one of which includes an edge for snap fastening automatically with an inclined undercut tongue integral with the other element, the latter part having an aperture which provides a hook by which the clamp is hung.

PREFERRED EMBODIMENT OF THE INVENTION

Figure 1:
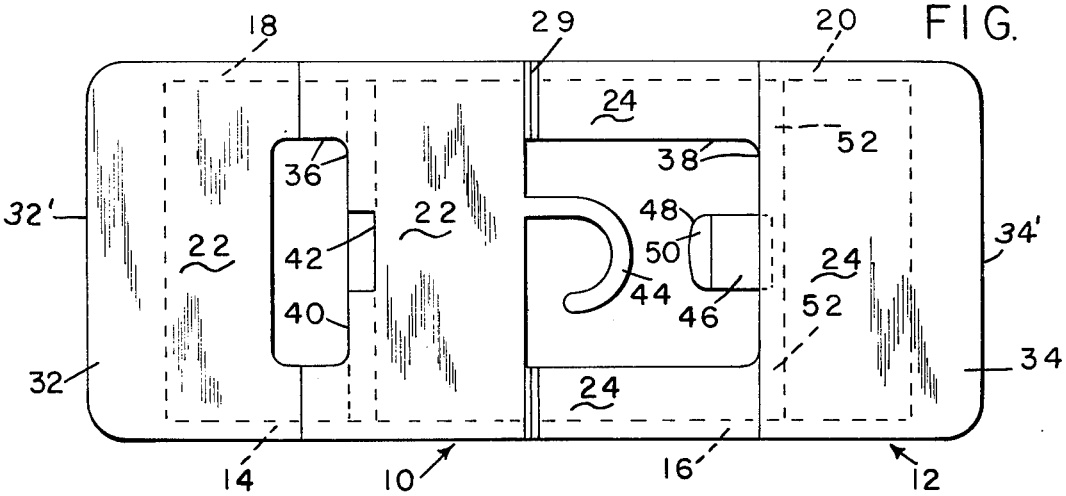
FIG. 1 is a plan view of the new clamp as molded.
Figure 2:
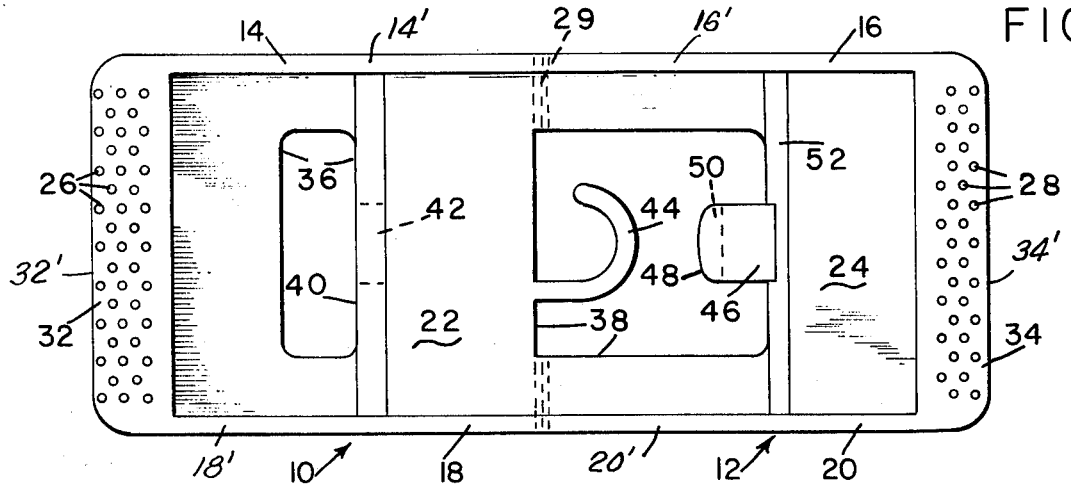
FIG. 2 is a bottom plan view thereof.
Figure 3:
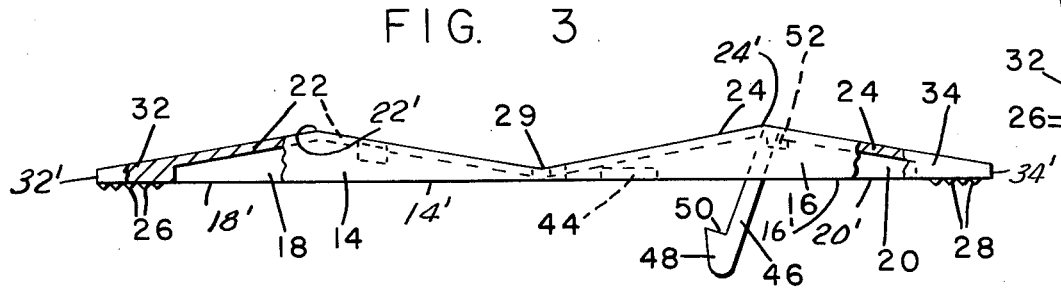
FIG. 3 is an edge view showing the clamp open.

Referring now to FIGS. 1, 2 and 3, these figures illustrate the device as it comes out of the molding machine. It is an elongated flat member comprising two main clamping elements 10 and 12. These clamping elements are flat and co-planar along the edges of upstanding edge flanges 14, 16, 18 and 20, which may be in the form of triangles and are for strengthening purposes, bordering inclined flats 22 and 24. The two inclined flats 22,22 are joined along a transverse ridge line 22', and together form outer faces for the clamping element 10. Likewise the two inclined flats 24,24 are joined along a transverse ridge line 24' and together form outer faces for the clamping element 12. The triangular flanges 14 and 18 on the opposite sides of the clamping element 10 are parallel and normal to the inclined flats 22,22. Each of the flanges 14 and 18 includes a pair of side edges which coincide with the side edge along one side of the inclined flats 22,22 and form an apex on ridge line 22'. The triangular flanges 14 and 18 have base edges 14' and 18' respectively extending between the joint end edge 29 and the free end 32'. Similarly the triangular flanges 16 and 20 on the opposite sides of the clamping element 12 are parallel and normal to the inclined flats 24,24. Each of the flanges 16 and 20 includes a pair of side edges which coincide with the side edges along one side of the inclined flats 24,24 and form an apex on the ridge line 24'. The triangular flanges 16 and 20 have base edges 16' and 20' respectively extending between the joint end edge 29 and the free end edge 34'.

Figure 4:
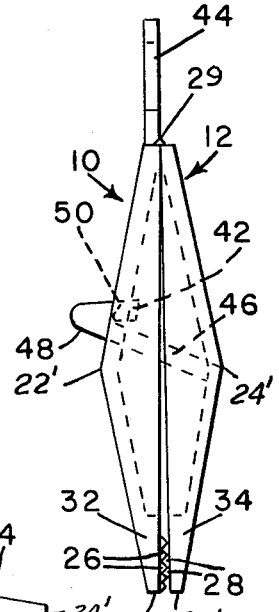
FIG. 4 is an edge view showing the clamp closed.

At the opposite ends thereof, the elements 10 and 12 are provided with two toothed portions 26 and 28, therebeing fold lines in the center of the device as at 29, so when folded to close as in FIG. 4, the teeth 26 and 28 intermesh to better hold an article therebetween. Also in the end portions of the device where the teeth are located, the material between the flanges 14 and 18 and 16 and 20 is solid as at 32 and 34, so for this small area, which is the gripping area, the same is made very strong but with a minimum amount of plastic material involved.

Referring now to FIGS. 1 and 2, each element 10 and 12 is provided with an individual aperture as at 36 and 38. Aperture 36 may be made elongated in a transverse direction thus providing an edge 40 having a cutout 42 for a purpose to be described; and the opening at 38 may be square and cutout to provide a hook shaped central element 44 by which the clip is to be hung on a wire, rack, etc.

Extending downwardly at an angle from the lower surface of element 12 there is an inclined latch member or tongue 46 which has a head 48 tapered as shown and with a substantially right angular cutback 50. This is for snapping over the edge at 42 to lock the parts automatically in position when swung together in the FIG. 4 position. The latch member or tongue 46 may be integral with a transverse strengthening rib 52. Other small strengthening cross ribs can be used if desired.

FIG. 4 shows the clamp in closed position, it being understood that between the teeth 26 and 28 there would be engaged an article of some kind for hanging by hook 44, and it will be seen that the hook 44 is flat and vertically straight up and is not cocked at an angle so that therefore the clamp hangs in a vertical plane as it should, and the entire clamp hangs straight and not cocked.

I claim:

1. A one-piece molded clamp having a pair of articulated clamping elements of rectangular configuration, each of said elements having a pair of parallel opposite sides, one end edge along which the element is integrally joined to a corresponding edge of the other clamping element and a free end edge opposite and parallel to said one end edge which contacts a corresponding free end edge of the other clamping element when the clamp is closed to provide an article grip, each of said clamping elements also having a pair of inclined flat portions defining outer faces joined to each other along a transverse ridge line intermediate said one end edge and said free end edge and a pair of triangular parallel side flanges bordering the opposite sides of and normal to the clamping element, each of said triangular flanges having a pair of side edges which form the side edges along one side of said inclined flat portions and which form an apex on said ridge line and a base edge extending between said one end edge and said free end edge of the element on which it is formed, flexible hinge means joining said clamping elements along their one end edge for swinging one of said clamping elements relative to the other about said one end edge thereof from an open position wherein said elements extend outwardly from each other in opposite directions with the base edges of said flanges lying in a common plane to a closed position wherein said base edges of said flanges on the same side of the clamping element abut each other, a separate aperture formed in each of said clamping elements, the aperture in one of said clamping elements being formed between the ridge line and the one end edge thereof and the other clamping element having a supporting hook integral wherewith and extending from said one end edge thereof into the aperture of said one clamping element when said element is open and which when the clamp is closed extends outwardly therefrom in a substantially medial plane between the clamping elements, the aperture in the other clamping element being spaced from said one end thereof, a latch integral with one of the clamping elements and a latch keeper integral with the other clamping element for holding the clamp in closed position with an article therebetween, said latch comprising an angular tongue extending from said one clamping element toward the aperture in the other clamping element and said latch keeper comprising an edge of the aperture in the other clamping element, said angular tongue having an undercut thereon for snapping past said latch keeper and being retained thereby.

2. The clamping element of claim 1 including teeth at the free ends of said clamping elements, said teeth being intermeshing.

3. The clamp of claim 1 wherein said free ends of said clamping elements are substantially thicker than the main portions of said clamping elements.

* * * * *